United States Patent [19]

Rubens

[11] 4,455,766

[45] Jun. 26, 1984

[54] SPRING-LOCKED ROTATABLE HEEL

[76] Inventor: Harry E. Rubens, 2 Sutton Pl. South, New York, N.Y. 10022

[21] Appl. No.: 326,030

[22] Filed: Nov. 30, 1981

[51] Int. Cl.[3] ..... A43B 21/24; A43B 21/30

[52] U.S. Cl. ..... 36/39; 36/38

[58] Field of Search ..... 36/39, 38, 36 R, 36 A, 36/36 C, 42

[56] References Cited

U.S. PATENT DOCUMENTS

| | | | |
|---|---|---|---|
| 2,104,924 | 1/1938 | Dellea | 36/38 |
| 2,313,368 | 3/1943 | Smith, Sr. | 36/39 |
| 2,535,102 | 12/1950 | Taylor | 36/39 X |

FOREIGN PATENT DOCUMENTS

| | | | |
|---|---|---|---|
| Ad.4452 | 5/1905 | France | 36/38 |
| 599766 | 5/1978 | Switzerland | 36/39 |
| 1041 | of 1885 | United Kingdom | 36/42 |
| 17948 | of 1889 | United Kingdom | 36/39 |

*Primary Examiner*—James Kee Chi

[57] ABSTRACT

A heel having a circular wear-element spring-locked to a heel base, in which position the wear-element may be manually unlocked against the spring action to permit rotation and relocation in a new position on the heel base, and being manually releasable for spring-locking in the relocated position.

7 Claims, 4 Drawing Figures

SPRING-LOCKED ROTATABLE HEEL

My invention relates to a rotatable wear-element in a heel for providing even wear around the circumference of a circular wear-element, for insuring a continuous trim appearance at the rear of the heel throughout the life of the shoe.

Such a rotatable wear-element is shown in my U.S. Pat. No. 3,085,359 which required that both the wear-element and the heel base to which the element is secured, be made of resilient material such as rubber which became very expensive and not economical for general use.

Another wear-element which may be rotated after wear to provide a new trim surface is shown in my U.S. Pat. No. 3,852,898 which is probably the least expensive of all rotatable wear-elements. This had the advantage of being attached to an existing heel, for protecting the same. Changing positions on the wear element involved using a tool to remove the wear-element which is required to be secured to the heel by a fastener or adhesive, for relocating the same, and reapplying the fastening means.

The present invention has for its object a quick and simple method for changing the wear-element without the use of tools or adhesives. Another object is to provide a wear-element which is positively locked into a secured position to prevent rotation while in the wear position, but which may be manually and easily moved into a new position, and manually released into the new and locked position.

I accomplish these and other objects of the invention by a wear-element which is spring-loaded to the heel base, as is described in the following description and claims, and as is illustrated in the drawings in which:

Figure 2:
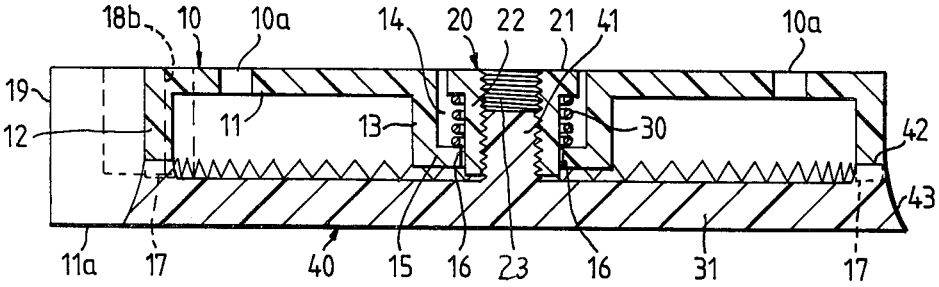
FIG. 2 is a cross-sectional view.
Figure 3:
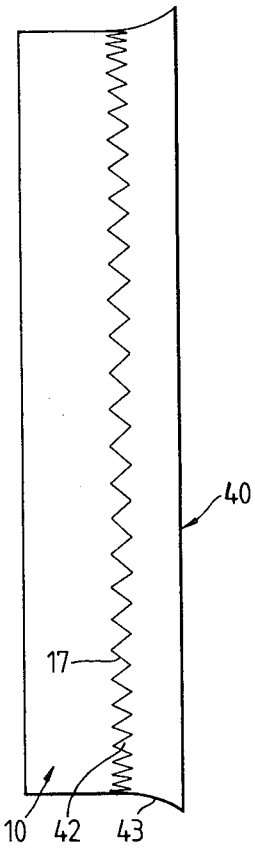
FIG. 3 is a side elevation.

In the form shown in FIG. 2, a heel base element 10 is provided with a downwardly extending peripherally positioned rim 12, and a centrally formed cup-shaped 13, forming a hollow 14, with the inwardly extending bottom wall 15 containing a central aperture 16. At the bottom edge of the rim 12, teeth 17 may be formed for interlocking purposes as will be hereinafter explained.

Figure 1:
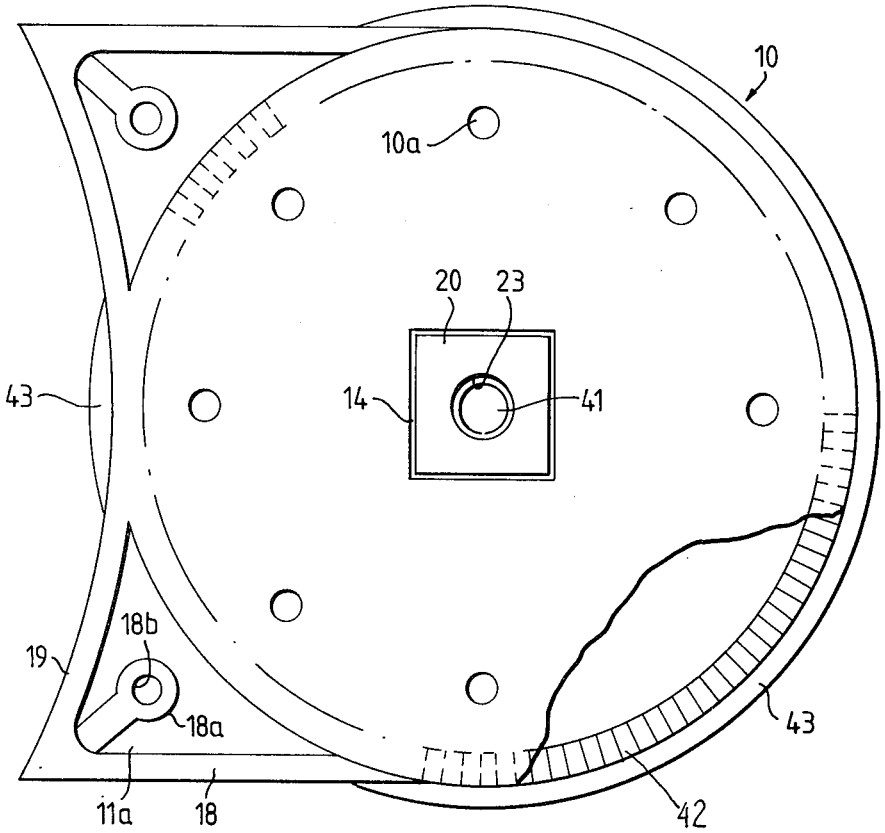
FIG. 1 is a top plan view of my heel, a portion thereof being partly broken away to show the interlocking structure.

Walls 18 and 19 form the side and rear faces of the heel base element to provide the convention shape found in present heels. The side and rear faces 18 and 19, are upwardly extending from the bottom face **11*a*, which together with the rim wall 12 forms a hollow body at the rear of heel base element to reduce the weight of the heel. Nail holes 10*a*, are provided in the upper face of the heel base element, while apertures 18*b* extend through extensions 18*a* from the bottom face 11*a*** in the hollow at the rear of the heel base element, as shown in FIG. 1.

The other elements of the heel structure comprises the nut 20, the coiled spring 30 and the wear-element 40.

The nut 20 is formed with a non-circular flange 21, which may be square to fit into the similarly shaped hollow 14 of the heel base element to prevent rotation with respect thereto. Below the flange 21, the nut is provided with a circular stem 22, and internal threads 23 for engaging the threaded bolt portion 41 extending from the wear-element 40.

The spring 30 is positioned beween the flange 21 of the nut 20, and the bottom wall 15 in the hollow portion 14 of the heel base element 10, and in compressed condition causes the wear element 40 to be forced upwardly against the teeth 17 of the base element 10. Teeth 42 are shaped around the peripheral edge of the wear element 40, extending upwardly to interlock with the rim teeth of the base element in the rim 12.

The stem 22 of the nut 20, extends freely through aperture 16 in the base element and has a length sufficient to accommodate the entire length of the bolt portion 41. Thus when the wear-element 40 is grasped manually, (and the edge 43 of the wear-element may be outwardly flared to provide a gripping surface,) and pulled away from the heel base element, against the action of the spring 30, to enable the wear-element to be free of the interlocking teeth 17 and 42. The wear-element may be rotated to a new position of the wear-element for even wear, or by continuing the rotation, the bolt may be unscrewed from the nut, and a new wear-element inserted when the used wear-element is replaced.

The entire wear-element may be made of structurally stiff but resilient material suitable for wear such as polyurethane. However the wear-element may be made of less expensive plastic material that is structurally suitable, and the lower face provided with a layer of polyurethane, or other suitable wear-resistant material 44 such as rubber, as is shown in FIG. 4, the wear-element being cemented or otherwise bonded during the molding process.

Figure 4:
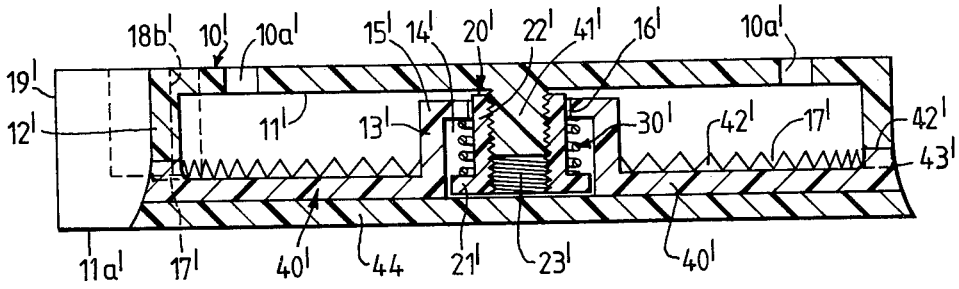
FIG. 4 is a cross-sectional view of a modification.

The modification in FIG. 4, is substantially identical with that shown in FIG. 2, except that the threaded bolt portion extends from the base element instead of from the wear-element. The nut is contained within the hollow portion extending from the wear-element instead of from the heel base element. The parts are similarly numbered, except that in the modification a prime (') has been added to indicate its position in the modification. As was pointed out above, the wear element 40, here 40', has a layer of polyurethane or other wear resisting material added. In the modification this also serves to close the opening to the opening to the hollow 14'.

The heel base element may be made of any material that has sufficient structural strength to be used as a heel material and which can be shaped into the desired form.

Instead of a spring metal coil, a ball of rubber may be used with a hollow portion to permit the bolt to extend therethrough, and sufficiently compressible to provide the desired spring-loading. Instead of a compression type spring, the desired tension may be obtained by an extended spring in tension, or an elastic band, each end of which is simply secured to one of the two elements while under tension. The locking and unlocking of the elements could take place as aforesaid.

I have thus described and illustrated the invention. I claim all equivalent constructions, as it is apparent that variations may be made in the resilient connection that integrates the wear element to the heel base element.

I therfore claim:

1. A heel comprising a heel base element, a rotatable wear element connected to the heel base element, and a resilient connector having two ends, one of which is continuously connected to the heel base element, and the other end connected to the wear element to permit rotation thereof with respect to the heel base element, said resilient connector being spring-loaded to force a resilient contact between the wear element and the heel base element at all times during the use of the heel, said connector being sufficiently resilient to permit manual separation of the contacting elements axially for relocating the position of the wear element with respect to the heel base element during the further use of the heel, and complementary fastening means having two ends, one end non-rotatably mounted with respect to the base element, and the other non-rotatably mounted with respect to the wear element.

2. The heel of claim 1, wherein the complementary fastening means comprise bolt and nut fastening means, and the connecting base and wear elements are provided with interlocking faces during use of the heel, said bolt and nut fastening means having sufficient unitary axial movement to permit separation of the interlocking faces for replacement or adjustment of the wear element.

3. The heel of claim 2, wherein the bolt fastening means extends integrally from the base element.

4. The heel of claim 3, wherein the bolt fastening means extends integrally from the wear element.

5. The heel of claim 1 in which a tube-like portion, open at both ends, extends integrally from one of the elements, the free end of which is provided with an inwardly extending ledge for supporting one of the ends of the resilient connector.

6. The heel of claim 1, wherein the complementary fastening means comprises a bolt mounted to one of the elements, a nut non-rotatably mounted with respect to the other of said elements, a coiled spring positioned between the nut and the other of the elements, to enable compression of the spring when the elements are in contact with each other.

7. The heel of claim 1, in which the peripheral edges of the wear element are provided with a finger-engaging surfaces to facilitate separation of the contacting surfaces.

* * * * *